US006194022B1

(12) United States Patent
Schunk

(10) Patent No.: US 6,194,022 B1
(45) Date of Patent: Feb. 27, 2001

(54) PROCESS FOR STABILIZING STRIP IN A PLANT FOR COATING STRIP MATERIAL

(75) Inventor: Eckart Schunk, Düsseldorf (DE)

(73) Assignee: Mannesmann Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/029,691

(22) PCT Filed: Sep. 4, 1996

(86) PCT No.: PCT/DE96/01715

§ 371 Date: Jul. 23, 1998

§ 102(e) Date: Jul. 23, 1998

(87) PCT Pub. No.: WO97/11206

PCT Pub. Date: Mar. 27, 1997

(30) Foreign Application Priority Data

Sep. 18, 1995 (DE) ..... 195 35 854

(51) Int. Cl.[7] ..... B05D 3/14

(52) U.S. Cl. ..... 427/8; 118/405; 118/419; 118/423; 118/672; 118/712; 427/431; 427/434.5; 427/434.7; 427/436; 427/443.2; 427/449; 427/598

(58) Field of Search ..... 427/8, 431, 434.5, 427/434.7, 436, 443.2, 598, 549; 118/672, 712, 405, 419, 423

(56) References Cited

FOREIGN PATENT DOCUMENTS

4344939 C1 * 12/1993 (DE) .
6136502 * 10/1992 (JP) .

* cited by examiner

*Primary Examiner*—Bernard Pianalto
(74) *Attorney, Agent, or Firm*—Cohen, Pontani, Lieberman & Pavane

(57) ABSTRACT

A process for stabilizing strip in a plant for coating strip material, in which a metal strip is taken through a container holding molten coating material that has, below the melt surface, a through channel, in which induction currents are induced by an electromagnetic travelling field in the coating material and, in interaction with the electromagnetic travelling field, generate an electromagnetic force to retain the coating material. In the region of the through channel, a controllable magnetic field superimposed on the modulation of the electromagnetic travelling field is applied, whose field strength and/or frequency are adjustable as a function of sensor-detected position of the strip in the coating channel.

2 Claims, 2 Drawing Sheets

PROCESS FOR STABILIZING STRIP IN A PLANT FOR COATING STRIP MATERIAL

BACKGROUND OF THE INVENTION

1. Field of the Invention

The invention relates to a process for stabilizing strip a plant for coating strip material, metal strip is taken through a container holding the molten coating material that has, below the melt surface, a through channel, in which induction currents are induced in the coating material by an electromagnetic travelling wave and, in interaction with the electromagnetic travelling field, generate an electromagnetic force to retain the coating material.

2. Discussion of the Prior Art

A plant of this type is described, for example, in German Patent 43 44 939. In this case, the container that holds the molten coating material has an opening for the strip in the bottom. The opening is sealed by an electromagnetic pump. The pump generates an electromagnetic force equal to or greater than the metallostatic pressure in the opening of the through channel. As a result, the molten material is prevented from running out through the opening.

It has been found that the strip, during continuous coating, is alternately deflected or twisted. A remedy for this is not possible with conventional means, e.g., an increase in bath tension. Further roller guides are not possible in this process area, because the coating has not yet solidified.

SUMMARY OF THE INVENTION

Starting from the described problems and disadvantages of the prior art, the object of the present invention is to find a process and a device for stabilizing strip in a generic plant, with which the strip material, without contact from outside, is brought into a more or less symmetrical position, so that the strip does not come into contact with the walls of the coating channel and sustain damage as a result. The stabilization is to be adaptable to different strip widths, strip thicknesses and material qualities.

To attain this object, it is proposed according to the invention that, in the region of the through channel, a controllable magnetic field superimposed on the modulation of the electromagnetic travelling field be applied. The field strength and/or frequency of the controllable magnetic field are adjustable as a function of the sensor-detected position of the strip in the coating channel.

The adjustable magnetic field allows the strip to be guided in the through channel so that the strip is introduced into the coating material without contacting the walls and without vibrations. Mechanical guides are this not necessary.

In one embodiment of the invention, the magnetic field is controlled as a function of the sensor-detected position of the strip in the coating channel. Depending on the position of the strip, the magnetic field is strengthened or weakened or unilaterally changed so that an appropriate correction of the strip course takes place.

Another embodiment, commonly uses the coils for the travelling field both for the purpose of sealing and for that of strip stabilization. The coil pair or pairs are controlled by means of thyristors, which are modulated to such an extent that a reliable seal is achieved. Depending on the position/asymmetry of the strip detected via sensors, an additional modulation of the coil pair or pairs is carried out for the purpose of attaining symmetry.

A device for stabilizing strip in a generic plant is characterized by multiple individually activatable and deactivatable magnetic coil pairs arranged on both sides of the strip in the region of coating channel, whose field strength and/or frequency are adjustable.

The magnetic coils can be arranged on both sides of the strip between the coils of the electromagnetic travelling field and the opening in the container bottom, for example, and can be dimensioned in keeping with the width of the strip.

Because the magnetic coils can be individually activated and deactivated, a more sensitive influence can be exercised on the magnetic field, and the magnetic field can be adjusted to different strip widths.

Alternatively, at least individual magnetic coils can be movably arranged parallel to the strip surface for the purpose of deliberately influencing certain regions of the strip surface and permitting adjustment to different strip widths.

If multiple magnetic coils are arranged on each side of the strip, the magnetic coils can be activated and deactivated individually, so that adjustment to different strip widths, thicknesses and materials is possible within wide limits.

BRIEF DESCRIPTION OF THE DRAWINGS

An example of the invention is shown in the drawings and described below. The drawings show.

DETAILED DESCRIPTIONS OF THE PREFERRED EMBODIMENTS

Figure 1:
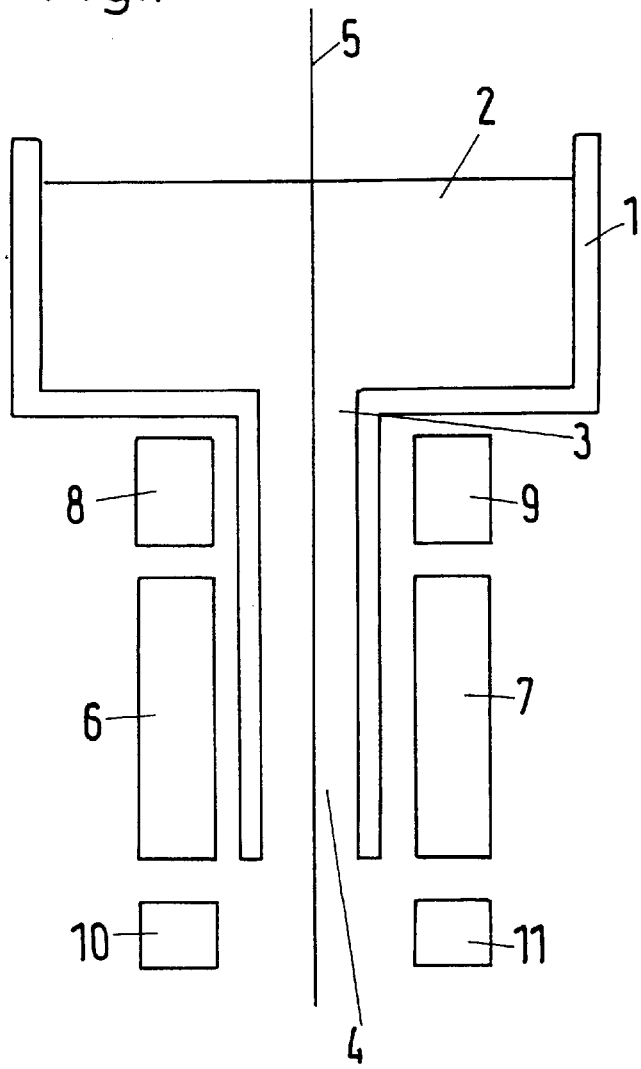
FIG. 1 is a schematic section of a container with molten coating material.
Figure 2:
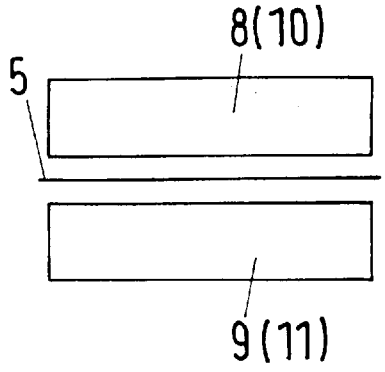
FIG. 2 shows the magnetic coil arrangement according to the invention, along with the strip along the line II-II FIG. 1.

FIG. 1 shows, in rough schematic fashion, a container 1 for molten coating material 2 with a bottom opening 3 that is continued by a through channel 4 for a strip 5 passing vertically through the container 1. Arranged around the through channel 4 are coils 6, 7, in which an electromagnetic travelling field is induced, which generates an electromagnetic force to retain the coating material 2. Above and/or below these coils 6, 7, there are additional magnetic coils 8, 9 and/or 10, 11, which are located on both sides of the strip 5 and the through channel 4 and extend over the entire width of the strip 5, as shown schematically in FIG. 2 in a cross-section through the strip 5 at the level of the magnetic coils 8, 9. According to the invention, the magnetic coils 8, 9 or 10, 11 can be controlled with respect to field strength and/or frequency, to allow adjustments to be made to different strip materials or strip thicknesses.

Figure 3:
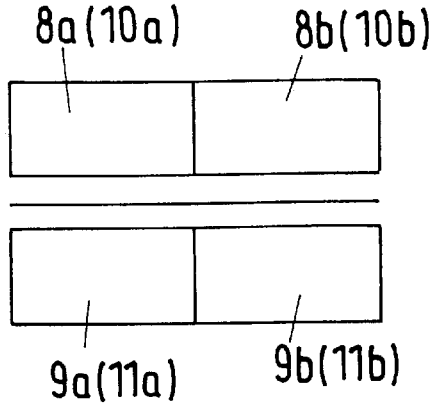
FIGS. 3 shows an alternative magnetic coil.

As FIG. 3 shows, two or more individually controllable magnetic coils 8*a*, 8*b*, 9*a*, 9*b* are provided on both sides of the strip 5, so as to provide an even better influence on the strip 5 in the magnetic field for stabilization according to the invention.

Figure 4:
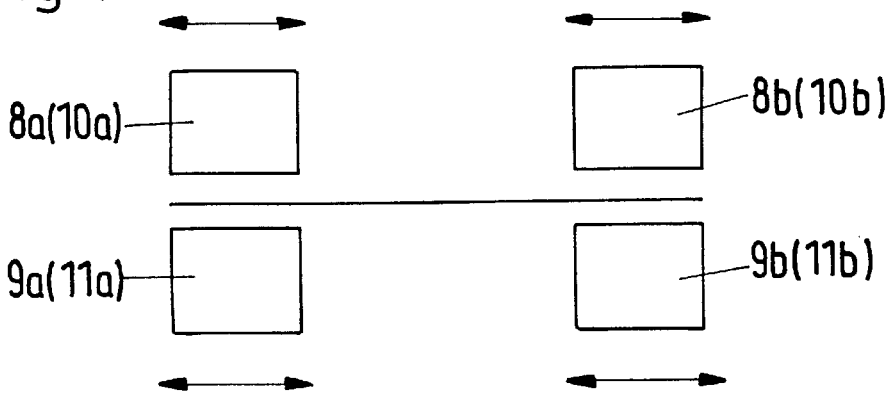
FIG. 4 shows yet another magnetic coil arrangement.

As FIG. 4 shows, the magnetic coils 8*a*, 8*b*, 9*a*, 9*b* are arranged at a distance from each other and are oriented toward the edge areas of the strip 5, and are movable in both directions parallel to the strip surface. As a result, precise adjustment to the strip width of the particular strip 5 passing through the container can be undertaken. The movement can be carried out hydraulically, pneumatically or by means of electric motor.

Figure 5:
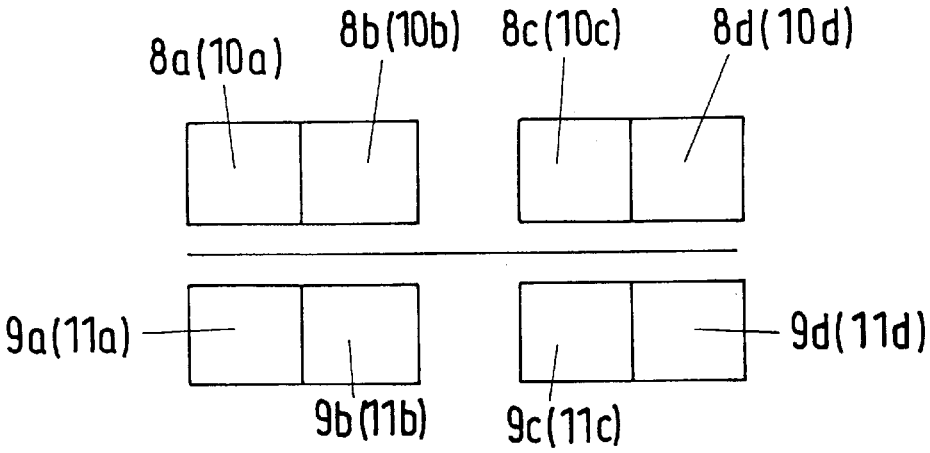
FIG. 5 shows still a further magnetic coil arrangement.

As FIG. 5 shows, on both sides of the strip 5, there are four magnetic coils 8*a*, 8*b*, 8*c*, 8*d*, 9*a*, 9*b*, 9*c*, 9*d*, of which the outer coils 8*a*, 9*a*, 8*d*, 9*d* can be activated and deactivated depending on the strip width. The coils can be divided into one coil above and one below each inductor.

To control the magnetic field, sensors can be arranged on the strip 5, for example, below the through channel 5, which, in the form of field strength measurement probes or strip position probes, correspond to the entering strip 5. The strip position detected by the probes is processed in a computer into a signal, with which the magnetic coils are controlled.

What is claimed is:

1. A process for stabilizing strip in a plant for coating strip material in which a metal strip is taken through a container holding molten coating material and has, below a melt surface, a through channel in which induction currents are induced in the coating material by an electromagnetic travelling field generated with magnetic coils, which, in interaction with the electromagnetic travelling field, generate an electromagnetic force to retain the coating material in the container, the process comprising the steps of:

superimposing a controllable magnetic field on the electromagnetic travelling field in a region of the through channel for stabilizing the strip; and simultaneously using the coils for the travelling field for sealing the container as well as for strip stabilization so that the control of the magnetic field, which has at least one of a field strength and a frequency that is adjustable as a function of a sensor detected position of the strip in the through channel, is superimposed on the modulation of the electromagnetic travelling field.

2. A process as defined in claim 1, including modulating the coil pairs via thyristors.

* * * * *